United States Patent [19]

Beam

[11] 4,258,916

[45] Mar. 31, 1981

[54] BATTING PRACTICE STAND

[76] Inventor: Billy G. Beam, Rte. 1, Box 39A, Mulberry, Ark. 72947

[21] Appl. No.: 60,009

[22] Filed: Jul. 24, 1979

[51] Int. Cl.[3] ..... A63B 69/40

[52] U.S. Cl. ..... 273/26 R

[58] Field of Search ..... 273/26 A, 26 R, 29 R, 273/29 A, 26 E, 184 B, 185 D, 185 G, 208, 200 B, 200 A, 183 C, 186 B, 197 R, 197 A, 196, 198, 181 R, 181 C

[56] References Cited

U.S. PATENT DOCUMENTS

| | | | |
|---|---|---|---|
| 1,591,753 | 7/1926 | Flaugh | 273/26 A |
| 2,897,674 | 8/1959 | McNeill | 273/184 B |
| 3,408,071 | 10/1968 | Lundy | 273/26 A |
| 3,472,075 | 10/1969 | Oppenheimer | 273/185 D |
| 3,980,304 | 9/1976 | O'Neill | 273/26 A |
| 4,089,521 | 5/1978 | Berst | 273/29 A |

*Primary Examiner*—Richard C. Pinkham
*Assistant Examiner*—T. Brown

[57] ABSTRACT

A batting practice device or stand comprising a batting arm carrying a target simulating a baseball, soft ball or the like, and a pivot element for hingedly mounting the batting arm in an upright frame for swinging movement in a vertical plane when the target is struck by a baseball bat or the like in the hands of a batter. The upright frame is provided with laterally disposed outrigger portions for supporting the frame in upright position.

8 Claims, 7 Drawing Figures

BATTING PRACTICE STAND

BACKGROUND OF THE INVENTION

The invention relates to a batting practice stand. The apparatus, if used properly, will improve the ability of the batter to hit a ball with a more even swing and also to hit precisely where he is looking, with more power in his swing.

It also has an adjustable mechanism so the user can guage his strength when hitting, and as he practices or works out he will be able to measure his improvement. It will also allow him to check his strength either right or left handed and determine if he has more power with wrist action or full arm swinging.

The apparatus includes a target simulating a baseball or soft ball mounted on the batting arm, swingingly mounted in a narrow box-like frame. The height of the target is preferably adjustable to correspond with the height of the batter, and means are provided for limiting the swinging movement of the batting arm in the box-like frame in one direction, and other means are provided for returning the target and batting arm to the original position after one stroke, in readiness for another stroke by the batter or operator.

In accordance with the preferred embodiment of my invention, the batting arm is swingingly mounted in an elongated narrow box-like frame portion having a generally rectangular partially open top and closed side and end portions. Outrigger portions extend laterally from the bottom of the box-like frame portion to provide stability for the apparatus. Mat portions extend laterally beyond the outrigger portions, which mat portions when opened up provide stands on either side of the box-like frame portion, on which a right or left handed batter may stand. The mat portions are provided with wheels which lend portability to the device when the mat portions are raised, and the box-like frame portion may be provided with a handle whereby the entire apparatus may be moved from place to place, supported on the wheels carried by the mat portions.

PRIOR ART

I am aware of numerous devices for simulated batting operations but none embodying the combination of features herein set forth having the advantages specified. The following patents are noted as representative of the prior art:

U.S. Pat. No. 959,402 Sullivan; May 24, 1910
U.S. Pat. No. 1,127,588 Carlson; Feb. 9, 1915
U.S. Pat. No. 1,248,056 Bachman; Nov. 27, 1917
U.S. Pat. No. 1,962,087 Cone; June 5, 1934
U.S. Pat. No. 2,818,255 Ponza; Dec. 31, 1957
U.S. Pat. No. 3,762,705 Gonzalez; Oct. 2, 1973
U.S. Pat. No. 3,794,320 Salmont; Feb. 26, 1974

The invention will be more readily understood by reference to the accompanying drawings, and the following detailed description of a preferred embodiment of the invention which are intended as illustrative only, rather than as limiting the invention to the exact details herein set forth.

DETAILED DESCRIPTION OF THE PREFERRED EMBODIMENT OF THE INVENTION

Figure 1:
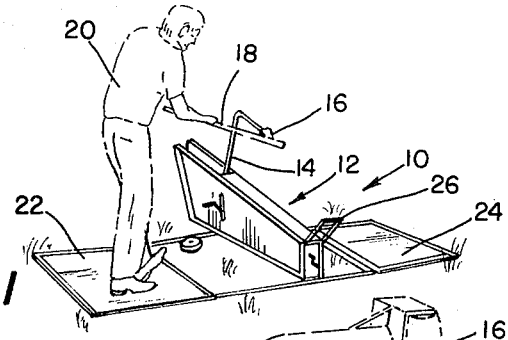
FIG. 1 is a diagrammatic view illustrative of the operation of the invention.

Reference will first be made to FIG. 1 wherein the principal features of the invention are diagrammatically shown.

My improved batting practice stand is generally designated by the reference numeral 10 and includes a narrow elongated box-like frame portion 12, in the bottom of which a goose necked batting arm portion 14 is hingedly mounted, the vertical position of which is adapted to be adjusted to accommodate batters of various heights. A target device simulating a baseball or soft ball is mounted on the end of the batting arm 14, which target 16 is adapted to be engaged by bat 18, carried by batter 20 who may stand on one of two mats 22 and 24 for right handed or left handed batting practice.

The height of the target and the batting arm portion 14 may be vertically adjusted for the convenience of the batter.

A handle 26 is shown as mounted at the rear of the frame or stand 12 for a convenience in moving the apparatus from place to place when wheels 40,42, to be more fully described hereinafter, are in operative position. The box-like frame 12, as shown in detail in FIGS. 2, 3 and 4, is provided with outrigger portions 28 and 30 extending laterally from the frame to provide stability for the frame or stand.

The mats 22 and 24 are provided with rigid reinforcing frames surrounding the same and arms 32 and 34, projecting from one end of the frames are pivotally connected to the outrigger portions 28 and 30 as shown at 36 and 38.

Figure 7:
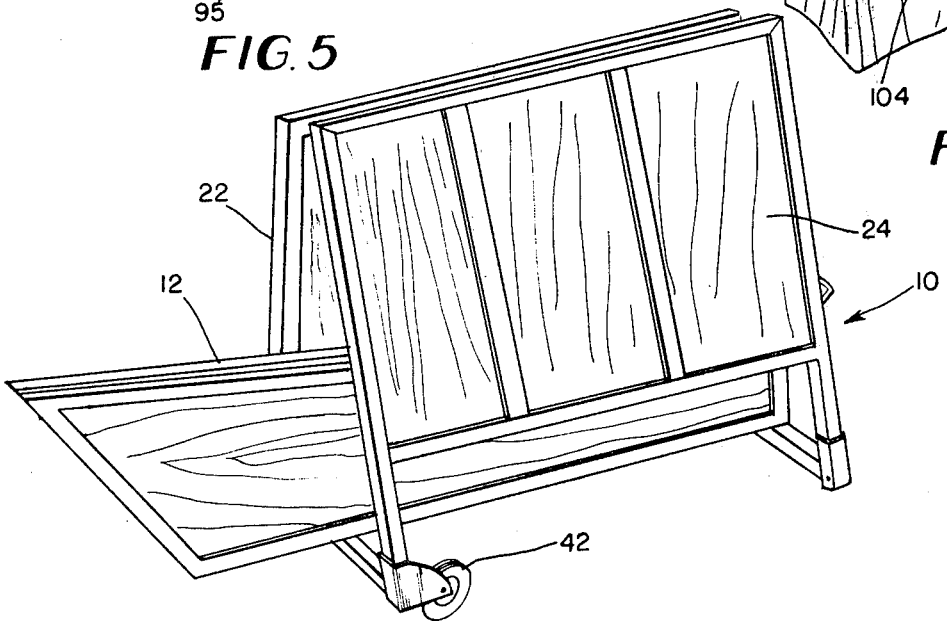
FIG. 7 is a perspective view somewhat diagrammatic in character showing the side mats in raised position partially enclosing the box-like frame (not fully shown), and showing one of the wheels shown in FIG. 3 in operative position to permit movement of the assembly from place to place by use of the frame carrying handle shown in FIGS. 2 and 3.

The wheels 40 and 42 are connected to the arms 32 and 34 by means of brackets 44 and 46, which wheels 40,42 are so arranged that when the mats 22 and 24 are folded upwardly about the pivots 36 and 38, as diagrammatically shown in FIG. 7, the wheels 40 and 42 will rest upon the ground and the entire apparatus may be moved from place to place by use of the operating handle 26.

Figure 2:
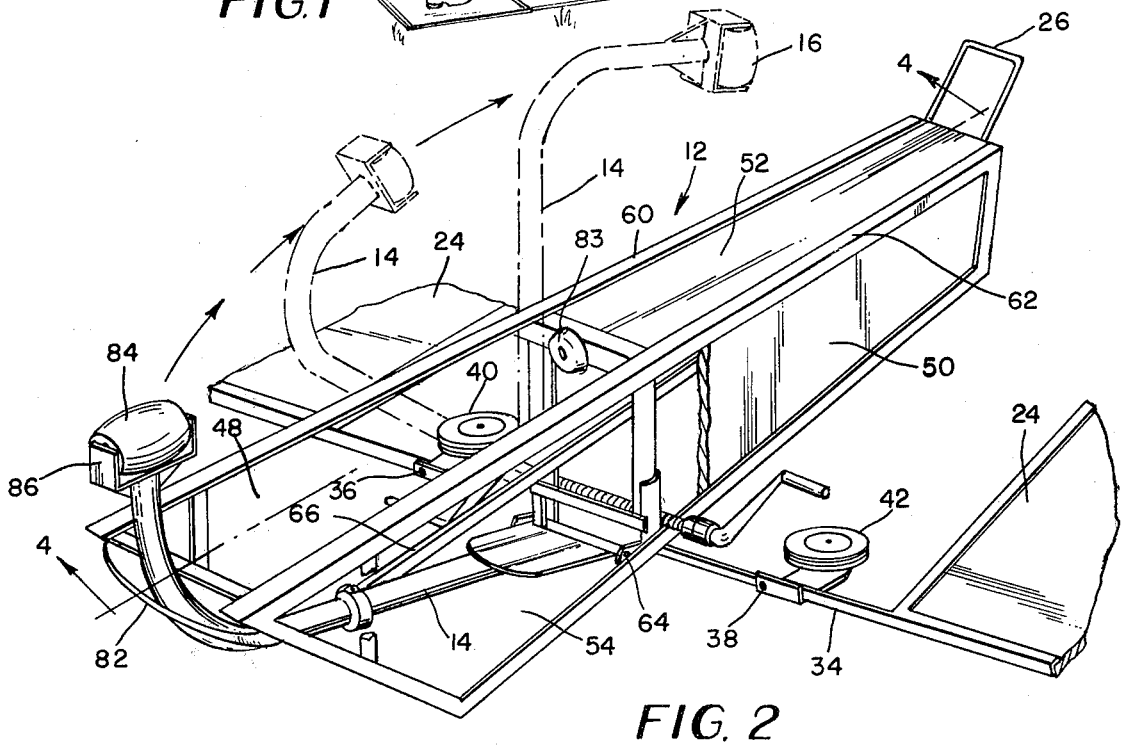
FIG. 2 is a perspective view on a larger scale than FIG. 1, showing the principal features of the apparatus with certain portions broken away, the target and batting arm being shown in full lines in the retracted position following a stroke by the batter, and being shown in phantom lines in the partially returned and fully returned portions respectively.
Figure 3:
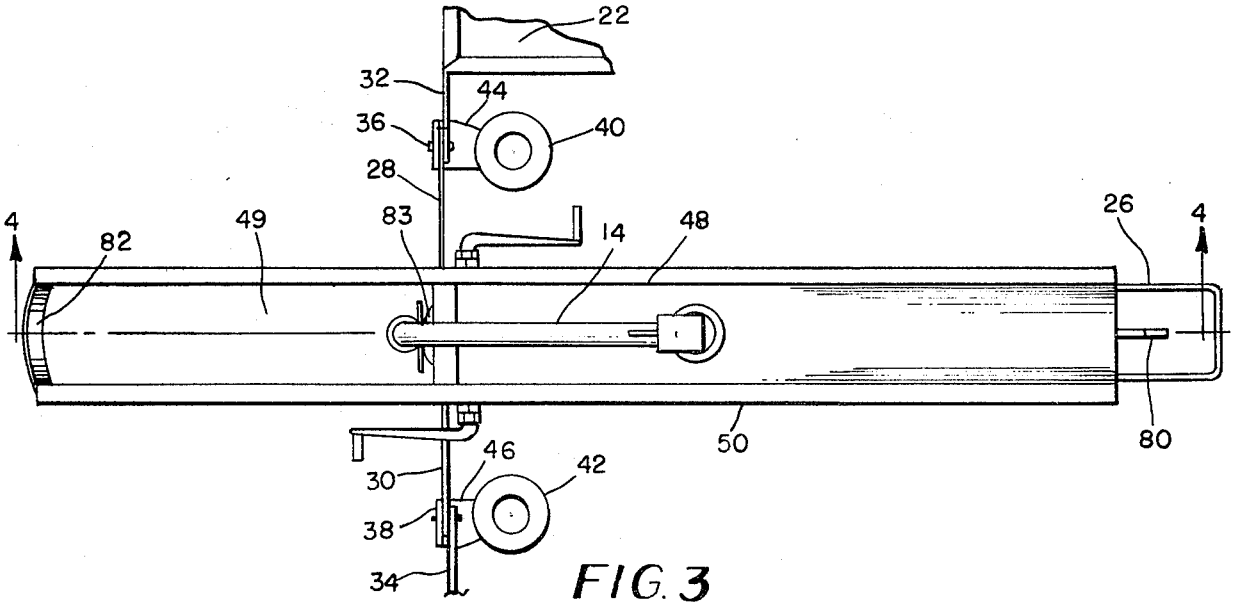
FIG. 3 is a top view of a portion of FIG. 2 on a slightly smaller scale including portions of the batter arm adjusting means.
Figure 4:
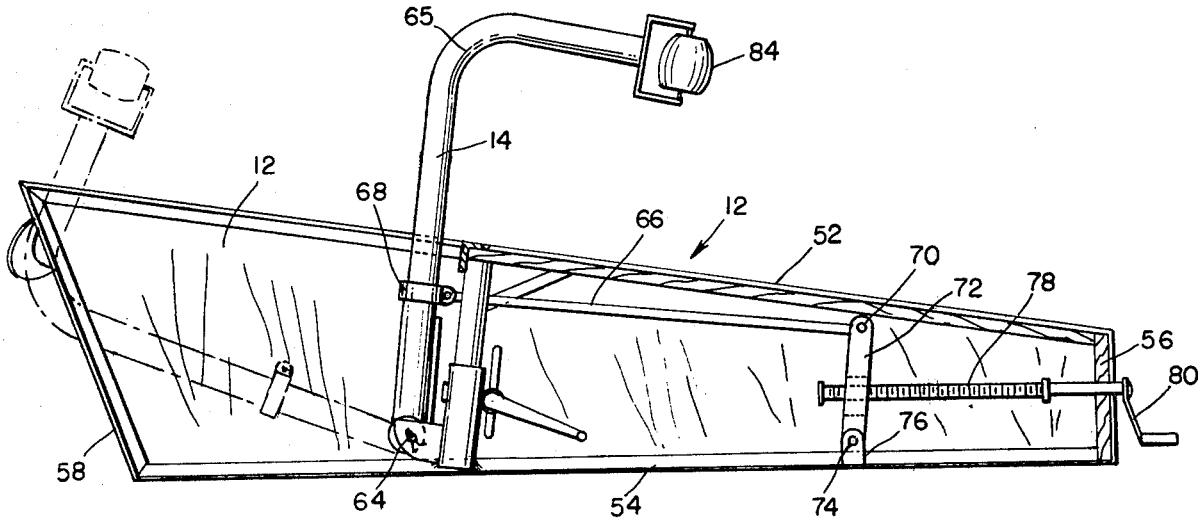
FIG. 4 is a vertical section on lines 4—4 of FIGS. 2 and 3, portions being shown in elevation, and certain features not shown in FIGS. 2 and 3 being shown in FIG. 4.

Referring to FIGS. 2, 3 and 4, the narrow box-like frame member or stand 12 which hingedly supports the batting arm portion 14 carrying the target 16, comprises side portions 48, 50, top and bottom portions 52, 54, a rear end portion 56 and an upwardly sloping front portion 58 extending outwardly from the bottom 54 to top 52.

Figure 5:
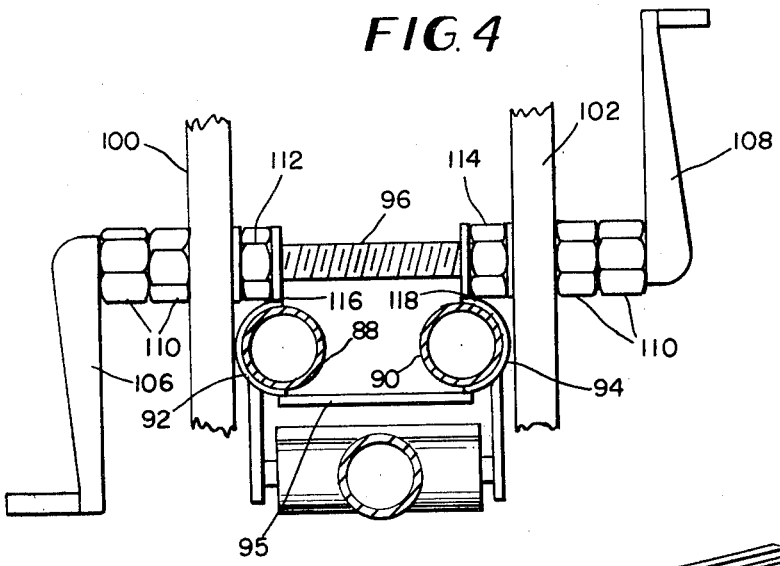
FIG. 5 is a detailed view of the batting arm adjusting mechanism shown in FIGS. 2, 3, and 4.
Figure 6:
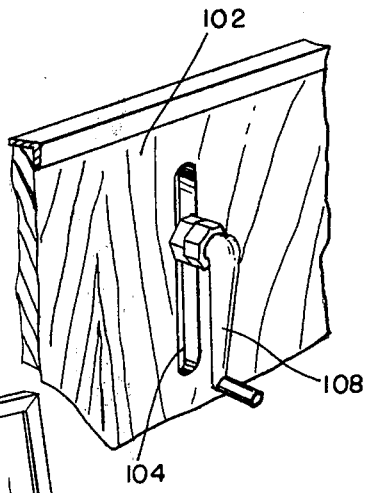
FIG. 6 is a further detailed view showing one crank arm of the batting arm adjusting mechanism projecting outwardly from a vertical slot in one of the side walls or panels of the box-like frame in which the batting arm and height adjusting mechanism are mounted.

The box-like frame 12 may be provided with panels which may be of plywood, metal or other suitable material. Upright side panels 100 and 102 are shown in FIG. 5.

Referring particularly to FIG. 2, the top portion 48 of the box-like frame 12 is shown as provided with side frame members 60,62 which extend from one end to the other of the frame, and the top is shown as closed at the rear end and open at the front portion to permit swinging of the target arm 14 within an open portion 49 (FIG. 3) when the target is hit by a baseball bat or the like.

The batting arm 14 is preferably tubular in form and is shown as pivoted at 64 at the bottom of the frame, and is curved intermediate its ends as indicated at 65 in FIG. 4. Suitable tension means are provided to restrain movement of the target arm which is also preferably vertically adjustable. Such restraining means is shown as an elastomeric band 66 of rubber or the like, or other resilient mechanism may be provided (not shown), as for example, a coil spring or a piston and cylinder. If desired, added resistance may be provided by use of an oil cylinder or dash pot which may be located and connected to the opposite side of the target arm 14 from the band 66 and suitably connected at the other end to a frame member (not shown). The dash pot tends to increase the resistance on the target arm 14 and a gage (not shown) may be provided to indicate the amount of pressure being applied at each stroke.

Referring particularly to FIG. 4, the band 66 is shown as connected at one end to the batting arm 14 by means of a collar 68, and is pivotally connected to the other end, by means of a pivot 70, to a lever arm 72, pivoted at its lower end at 74 to a frame member 76 projecting upwardly from the bottom of the frame. The tension of the elastomeric member 66 may be adjusted by means of a screw 78 extending through the lever arm 72 and screw threaded therein, and provided at its rear end with a crank arm 80 for operating the screw 78. It will be obvious that if the rubber band 66 is substituted by a coil spring or the like, a similar screw adjustment would likewise be applicable. At the forward end of the frame, an elastomeric band 82 or other suitable cushioning means may be provided for engagement by the batter arm 12 at the forward end of its stroke as indicated in FIGS. 2 and 3, and resilient stop means 83 carried by the frame may be provided for limiting the return movement of the batting arm 14.

For the purpose of identification, I have designated the member 16 carried by the batting arm 14 as a target. By this I refer to a simulated hard or soft ball adapted to be engaged by the bat 18 carried by the batter 20. The target 16 may be of any suitable material such as rubber or the like, and in FIGS. 2 and 4 is shown as in the form of a roller 18 carried by bracket 86 at the upper end of the batter arm 14 beyond the curved portion 65.

In accordance with my invention, the batter arm 14 is adapted to be vertically adjustable either manually or mechanically to suit the convenience of the batter. To provide for swinging and vertical adjustment of the batting arm, I have shown two tubular posts 88 and 90 mounted on the floor of the frame 12. These tubular posts are shown as provided with arcuate clamps 92 and 94 which may be either clamped to the posts 88 and 90 or released therefrom by the operation of suitable mechanism. The clamps are flexible and carry between them stub arms to which the batting arm 14 is pivotally connected as at 64, thus rendering the batter arm swingable with reference to the posts 88 and 90 of the frame 12, and also vertically adjustable with reference thereto. As shown in FIG. 5, the flexible clamps 92 and 94 are interconnected as at 95. In the specific embodiment shown, the batter arm 14 may be moved up or down manually when the clamps are disengaged from the posts 88 and 90 but may be changed into any desired adjusted position. The means herein shown is adapted to release or clamp the arcuate members to the posts 88 and 90, but suitable means (not shown) may be provided for raising or lowering the clamps together with the batting arm 14 to any desired adjusted position.

Reference will now be made to the actuating means for the arcuate clamps 92 and 94 for engaging or disengaging the stationary posts 88 and 90, as principally shown in FIG. 5, and also partially shown in FIGS. 2, 3, 4 and 6. As shown in FIG. 5, a shaft 96 screw threaded intermediate the upright panels 100 and 102 extends between side panel portions 100 and 102 of the box-like carrying frame 12 for the batting arm 14. The panels 100 and 102 are vertically slotted to accommodate the unthreaded ends of the shaft 96, one such slot being shown at 104 in FIG. 6. Crank arms 106 and 108 are attached to opposite ends of the shaft 96 for rotation thereof.

The crank arms 106 and 108 are provided with large nuts or spacers 110—110 which loosely fit the ends of the shaft 96 outside of the side panels 100 and 102 and are larger than the slots in the panels. Inner nuts 112 and 114 are screw threaded on the shaft 96 inside the slotted panels and are connected to the arcuate clamps 92 and 94 as by welding at 116 and 118.

By proper arrangement of the screw threaded portion of the shaft 96, which is between the upright side panels 100 and 102, as for example, by slanting the screw threads adjacent the clamping nuts 112 and 114 respectively in opposite directions relative to each other, the clamping nuts 112 and 114 connected to the clamps 92 and 94 may be moved in opposite directions relative to each other to cause the clamps to engage or disengage the upright posts 88 and 90 carried by the upright frame 12. When the clamps 92 and 94 are disengaged from the posts, the batting arm 14 may be raised or lowered according to the height of the batter and may be again clamped to the posts by the rotation of the crank arm or arms in the proper direction, it being understood that the crank arms 106 and 108 are secured to the ends of the shaft 96 for rotation therewith, but may be made detachable if desired.

OPERATION

The operation of the stand will be largely apparent from the foregoing description and the accompanying drawings.

The portable stand 10, shown in transporting position in FIG. 7, will be moved to a selected playing position, and the hinged mats 22 and 24 will be unfolded and placed on the ground as indicated in FIG. 1 to provide for either left or right hand batting. The goose neck batting arm 14 carrying the target 16 simulating baseball or the like will be vertically adjusted to the proper height to suit the convenience of the batter 20 who then strikes the target 16 with the bat 18. The arm 14 swings to the left as indicated in FIG. 4 and is then returned to the original batting position by means of the tension means or band 66, the tension of which is adjustable. The batting practice may continue as long as desire, the batter using either of the mats 22 and 24 for right or left handed practice.

The resistance to the striking operation by the batter may be regulated by adjusting the tension of the band 66. When the batting practice has been completed at a particular location, the mats 22 and 24 and their rigid frames may be folded upwardly as indicated in FIG. 7, to at least partially enclose the upright frame portion 12 and the batting arm 14 carried thereby. When in the position shown in FIG. 7, the entire stand 10 is portable and may be moved from place to place by means of the handle 26 shown in FIGS. 1, 2 and 3 with the wheels 40 and 42 carried by the frames of the mats 22 and 24 resting on the ground.

The invention has been described in detail for the purpose of illustration, but it will be obvious to those skilled in the art that numerous modifications and variations may be resorted to without departing from the spirit of the invention in its broadest aspect, as set forth in the following claims.

What is claimed is:

1. A batting practice device comprising a batting arm carrying a target simulating a baseball or soft ball, and means for hingedly mounting the batting arm in an upright frame for swinging movement in a vertical plane when the target is struck by a baseball bat in the hands of a batter, a portable box-like frame having parallel sides and a bottom in which the batting arm is hingedly mounted for swinging movement in a vertical plane parallel to the upright sides of the frame and means carried by the frame for limiting the swinging movement of the batter arm in either direction, wherein the frame includes laterally disposed outrigger portions for supporting the frame in upright position with the sides in parallel vertical planes and the batting arm swinging in a vertical plane intermediate the sides.

2. A batting practice device as defined in claim 1 wherein the batting arm includes a curved portion intermediate the support means and the target.

3. A batting practice device as defined in claim 1 wherein the batting arm is vertically adjustable in said vertical plane.

4. The combination set forth in claim 1 wherein the frame is provided with a pair of batter supporting mats hingedly secured to said outrigger portion to provide stands for right and left hand batting.

5. The combination defined in claim 4 wherein the mats may be swung to an upright position to substantially enclose the frame and the batting arm carried thereby.

6. The combination defined in claim 5 wherein wheels are carried by said mats, which wheels when the mats are swung to upright folded position serve to lend portability to the apparatus, and handle means, carried by the frame, cooperating with said wheels.

7. A batting practice device as defined in claim 1 including means for returning the batting arm to its original batting position after the target has been struck and moved to one end of its trajectory.

8. A batting practice device as defined in claim 7 wherein said arm returning means is resilient and adjustable to provide greater or less resistance to the batting operation as may be desired by the batter.

* * * * *